US006257743B1

(12) United States Patent
Ursch

(10) Patent No.: US 6,257,743 B1
(45) Date of Patent: Jul. 10, 2001

(54) BARRIER WALL MOUNTING PLATE FOR ELECTRICAL FIXTURE ENCLOSURE

(75) Inventor: Richard W. Ursch, County of Fenton, MO (US)

(73) Assignee: Dal Partnership, St. Louis, MO (US)

( * ) Notice: Subject to any disclaimer, the term of this patent is extended or adjusted under 35 U.S.C. 154(b) by 0 days.

(21) Appl. No.: 09/376,836

(22) Filed: Aug. 18, 1999

(51) Int. Cl.[7] ..... F21V 19/02
(52) U.S. Cl. ..... 362/418; 362/147; 362/427
(58) Field of Search ..... 362/418, 427, 362/287, 147, 430

(56) References Cited

U.S. PATENT DOCUMENTS

| | | | | |
|---|---|---|---|---|
| 1,659,404 | * | 2/1928 | Lipschutz | 248/343 |
| 5,477,439 | * | 12/1995 | Kowalenko et al. | 362/260 |
| 5,537,304 | * | 7/1996 | Kluas | 362/373 |
| 5,549,266 | * | 8/1996 | Mitchell et al. | 248/205 |

* cited by examiner

*Primary Examiner*—Stephen Husar
*Assistant Examiner*—John Anthony Ward
(74) *Attorney, Agent, or Firm*—Polster, Lieder, Woodruff & Lucchesi

(57) ABSTRACT

A lighting fixture (F) has a canopy (C) formed thereon. Electrical wiring (W) for a lamp socket (K) of the fixture is routed through the canopy. One end of each wire electrically connects to the socket, and the other end of each wire extends through the canopy. A mounting plate (10) fits over an opening defined by the canopy and is secured to the canopy. The plate has a central opening (16) through which the free ends of the wires extend. An outlet box (B) has an opening (G) in a sidewall (S) for routing electrical wires connecting the fixture to a power source. Ends of the electrical wires are spliced together and exposed ends of the spliced wires are covered with wire nuts (U). The mounting plate includes a swivel bar (24) attached to the plate on its side (26) to which the outlet box attaches. By attaching the outlet box to the swivel bar, and then the mounting plate to the fixture, the fixture can be adjusted to any orientation regardless of the orientation of the outlet box.

16 Claims, 5 Drawing Sheets

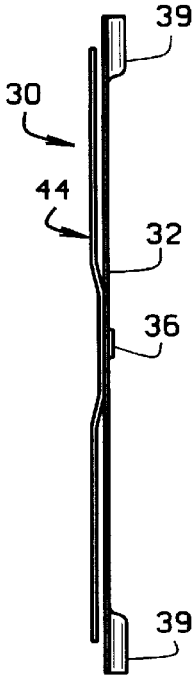
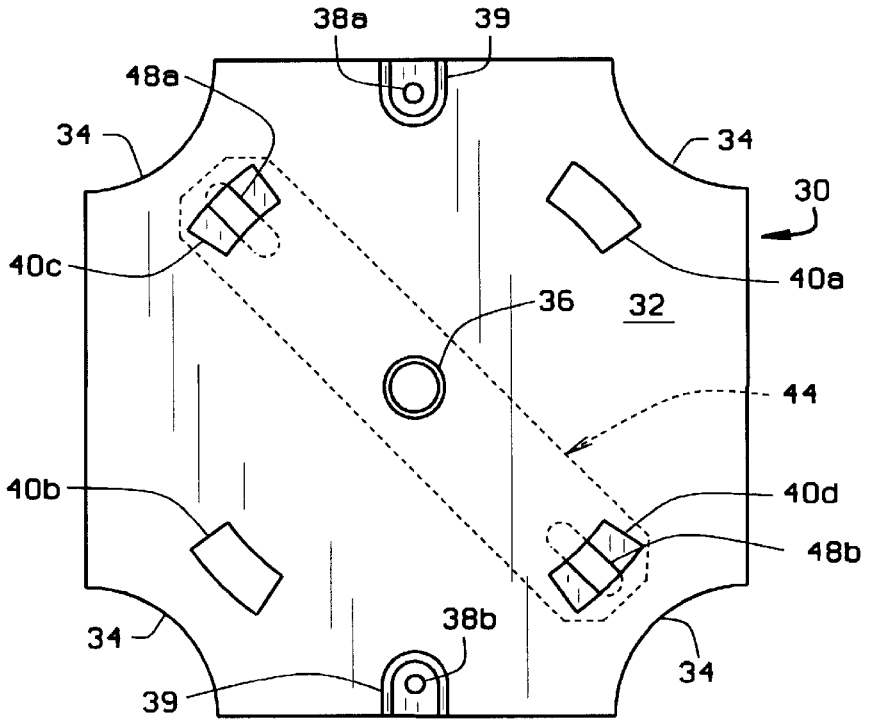
FIG. 5B FIG. 5A
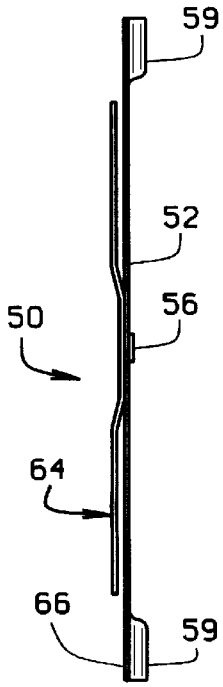
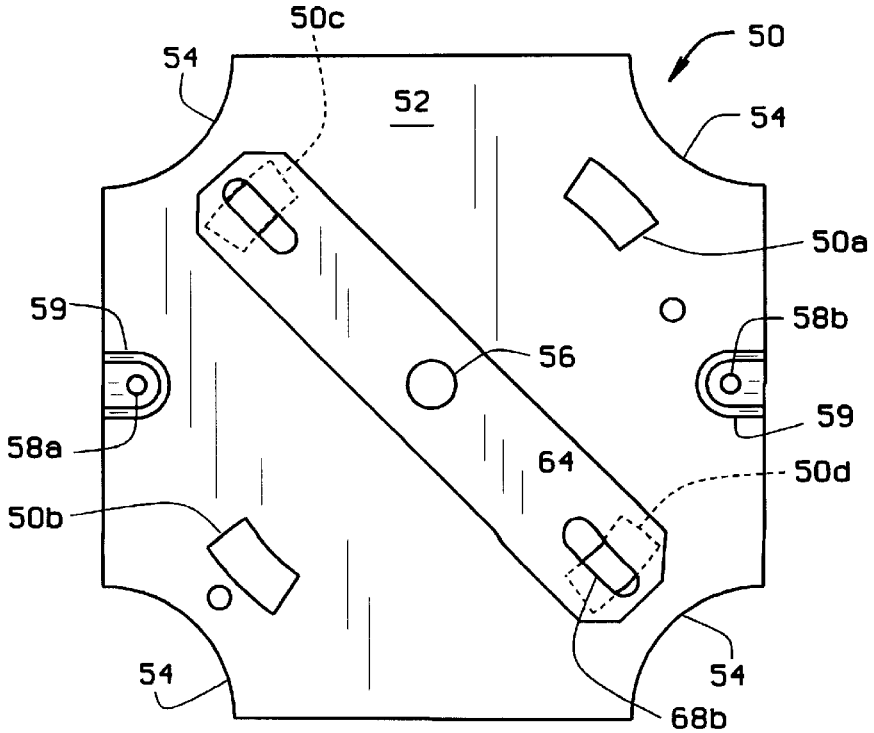
FIG. 6B FIG. 6A

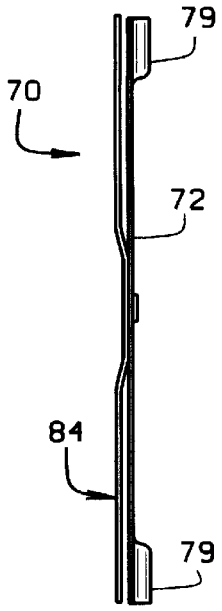
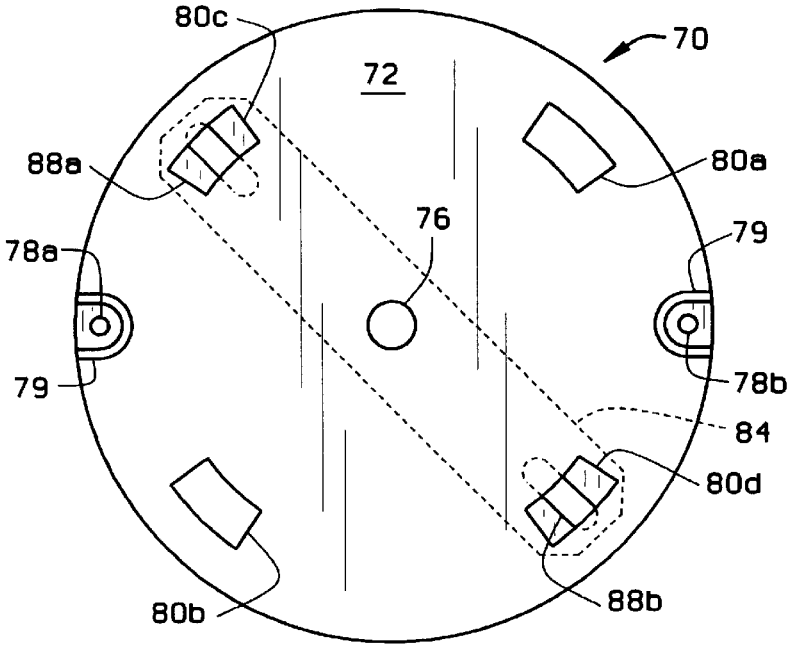
FIG. 7B FIG. 7A
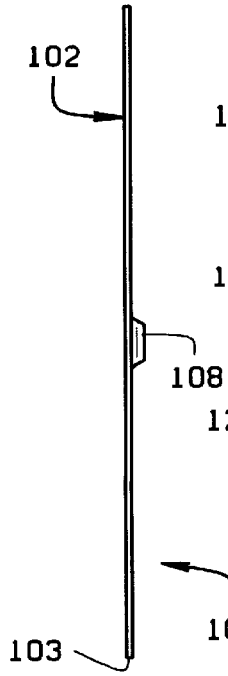
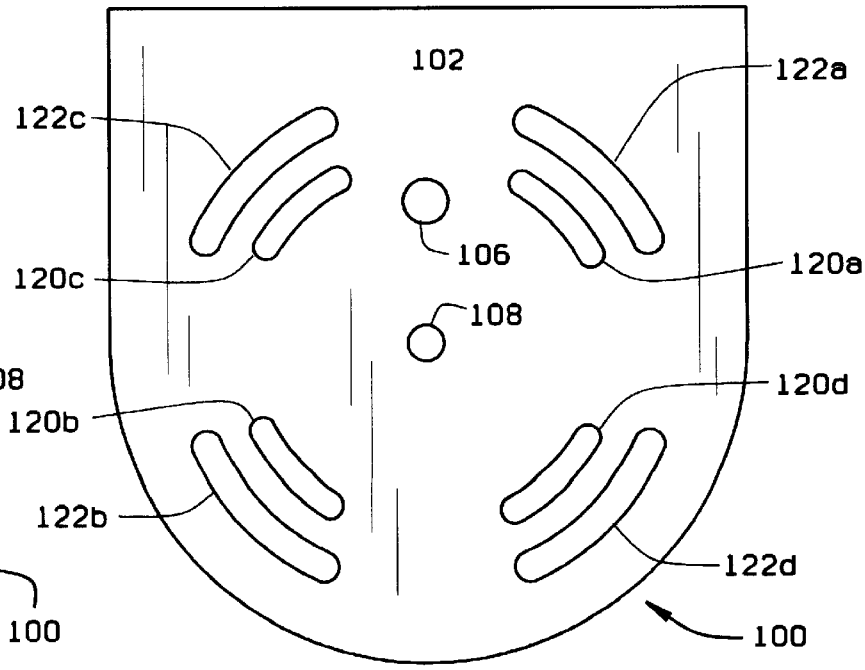
FIG. 8B FIG. 8A

BARRIER WALL MOUNTING PLATE FOR ELECTRICAL FIXTURE ENCLOSURE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to electrical fixtures such as ornamental lighting fixtures and the like, and more particularly, to a mounting plate for use in installing the fixture.

Referring to the prior art construction shown in FIG. 1, an electrical lighting fixture such as an outdoor lighting fixture F is made of metal or a molded plastic material. On one side of the fixture a canopy C is formed through which electrical wiring W for a lamp socket K is routed. The fixture typically includes three electrical wires W1–W3 one end of each of which are electrically connected to the lamp socket. The other ends of each wire are initially free.

A mounting bar P is formed to fit in an opening defined by an inner wall surface of the canopy. Electrical wires (not shown) from a wall switch or the like are routed through an opening G in a sidewall S of an electrical outlet box B which is already mounted in place in a wall. Ends of these other electrical wires are spliced together with the free ends of the wires W1–W3, and the exposed ends of the attached wires are covered with wire nuts U that are threaded onto the wires. Mounting bar P is then attached to outlet box B by screws (not shown) which fit through holes H formed in the bar. The spliced ends of the wires are now completely enclosed within a space defined by the outlet box and mounting plate. This must be done in accordance with paragraph 7.1 of Underwriter's Laboratory (UL) standard 1571, in order for the fixture to receive UL approval. The mounting plate is now attached to canopy C by screws E which fit through notches R formed on opposite sides of the mounting plate, and through openings (not shown) in the canopy. The ends of the screws E project through these openings and cap nuts T are threaded onto the exposed ends of the screws to provide a decorative appearance. This rigidly attaches the mounting plate and outlet box to the fixture.

From an aesthetic standpoint, an installed fixture such as outdoor lighting fixture F is mounted in a preferred orientation, vertical, for example. The fixture, when mounted in place, should not appear to be canted to one side or the other. However, it often occurs that the fixture is canted when the fixture/outlet box assembly is installed in place, and this condition can be time consuming and costly to correct.

BRIEF SUMMARY OF THE INVENTION

Among the objects of the invention are the provision of a mounting plate for use in installing electrical fixtures. The mounting plate is made of metal or a polymeric material and attaches to and covers an outlet box containing all electrical wiring splices made in electrically connecting the fixture to a power source. Another object of the invention is a mounting plate having a swivel bar mounted thereto on the side of the plate to which the outlet box attaches. The outlet box attaches to the swivel bar so to enclose the wiring splices between the mounting plate and outlet box, in accordance with UL standards. However, provision of the swivel bar allows the electrical fixture to be rotated with respect to the outlet box so the fixture is oriented in any desired position regardless of the outlet box orientation.

Another object of the invention is a mounting plate which provides an electrical enclosure and accessibility barrier. The fixture can be molded out of polymeric materials not having to meet UL requirements for an electrical enclosure. The mounting plate design further resolves all issues relating to the maximum size of open holes in an enclosure as specified in Table 9.1 of UL standard 1571 relating to incandescent fixtures.

An additional object of the invention is a concept which is also applicable for fluorescent and other types of fixtures as well.

In accordance with the invention, generally stated, a lighting fixture made of metal or a molded plastic material includes a canopy formed on one side. Electrical wiring for a lamp socket of the fixture is routed to the socket through the canopy. One end of each wire is electrically connected to the socket, and the other, free end of each wire extends through the canopy. A mounting plate fits over an opening defined by the canopy and is secured to the outlet box. The mounting plate has generally the same shape as the fixture canopy so to form a barrier between the outlet box and the canopy. The plate has a central opening through which the free ends of the wires extend. Electrical wires for connecting the fixture to a power source are routed through an opening in a sidewall of an electrical outlet box. Ends of these electrical wires are spliced together with the free ends of the other wires, and the exposed ends of the spliced wires are covered with wire nuts, electrical tape, or the like. The mounting plate could include a swivel bar attached to the plate on the side of the plate to which the outlet box attaches. The swivel bar is first attached to the outlet box, and the fixture canopy is then attached to the mounting plate. This allows the fixture to be positioned in any orientation regardless of the outlet box orientation. The electrical wires are completely enclosed by the outlet box and mounting plate as required by UL standards. Other objects and features will be in part apparent and in part pointed out hereinafter.

BRIEF DESCRIPTION OF THE SEVERAL VIEWS OF THE DRAWINGS

In the drawings,

FIGS. 5A and 5B, and 6A and 6B illustrate alternative embodiments of a rectangular plate for use with other fixtures; and, FIGS. 7A and 7B and 8A and 8B illustrate generally circular shaped plates for use with yet other fixtures.

Corresponding reference characters indicate corresponding parts throughout the drawings.

DETAILED DESCRIPTION OF THE INVENTION

Figure 1:
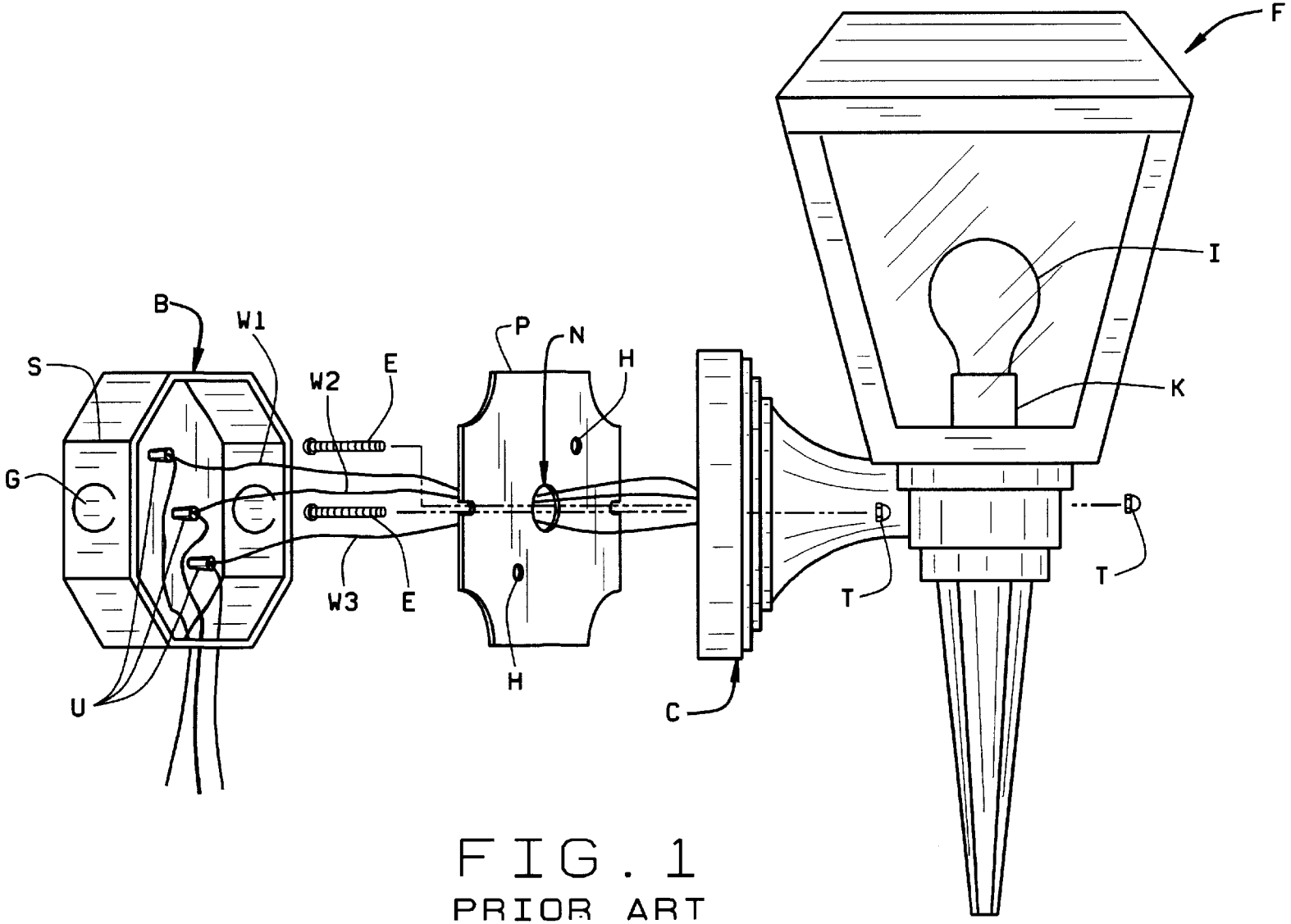
FIG. 1 PRIOR ART
FIG. 1 is an exploded view of a prior art electrical fixture/outlet box assembly.
Figure 2:
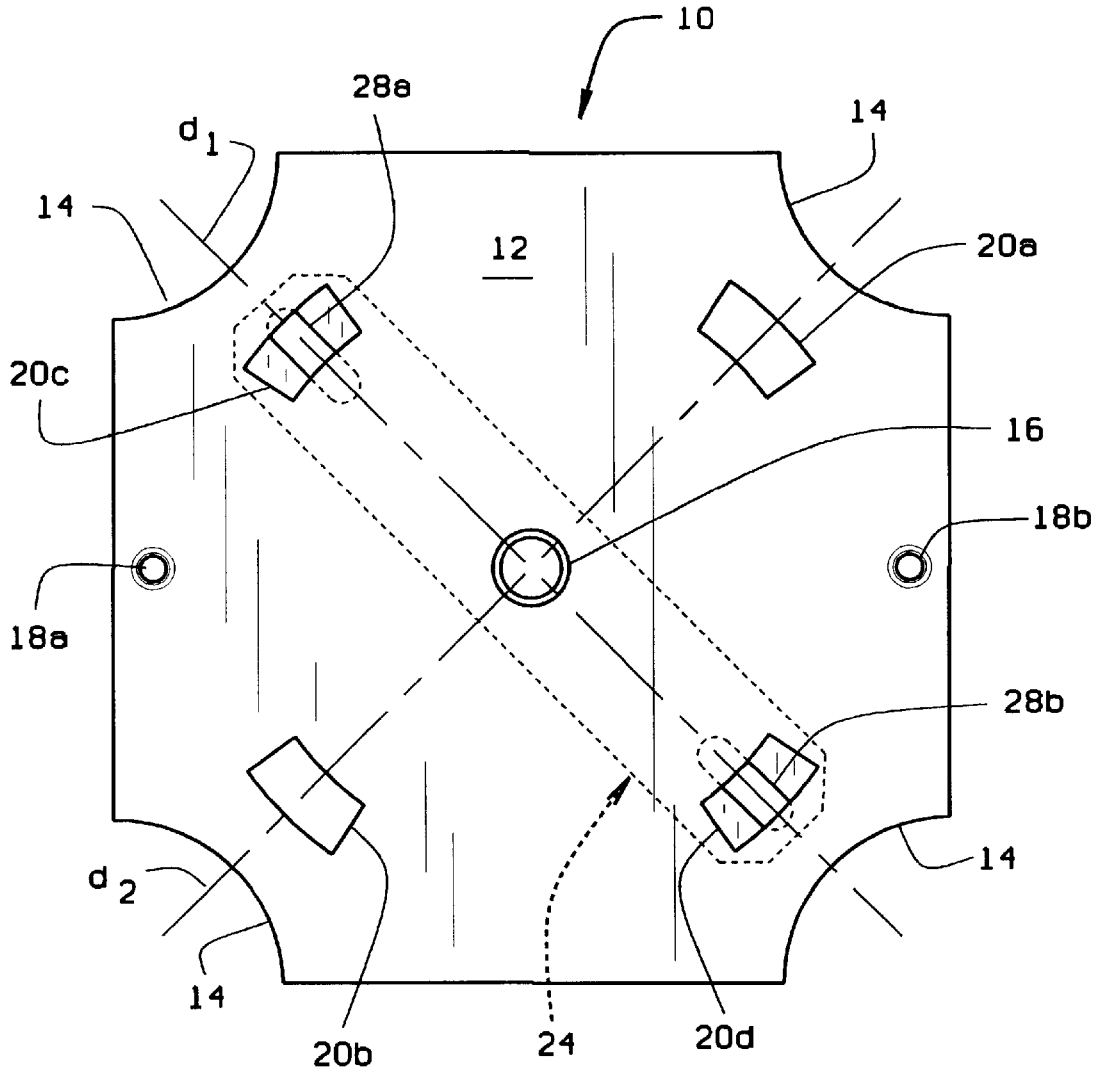
FIG. 2 is a rear elevational view of a mounting plate of the present invention.
Figure 3:
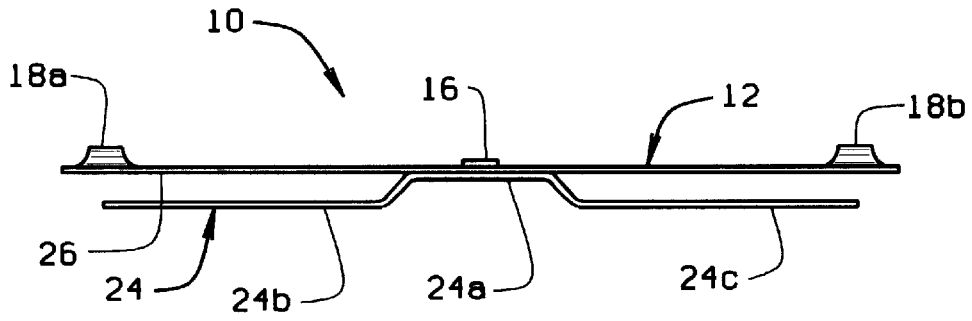
FIG. 3 is a side elevational view of the mounting plate.

Referring to the drawings, the prior art construction shown in FIG. 1 has been previously described, as have the installation problems associated therewith. Referring to FIGS. 2 and 3, an improvement of the present invention includes a barrier wall mounting plate indicated generally 10 which is for use with fixture F and replaces the mounting plate P described with respect to FIG. 1. Barrier wall mounting plate 10 first includes a flat plate 12 whose outer contour is shaped so the mounting plate is received in an opening defined by an inner wall of a fixture canopy. For example, as shown in FIG. 2, each corner of the plate is scalloped, as indicated at 14. The plate has an opening 16 for the free ends of electrical wires connected to the fixture lamp socket to be pulled through the opening. Opening 16 is swedged and edge rolled as shown in FIG. 3. Plate 12 further includes a pair of opposed, tapped openings 18*a*, 18*b*. These openings are for attaching the mounting plate to the fixture canopy. The mounting plate is attached to canopy C by screws as the screws E which fit through the tapped openings, and through openings (not shown) in the canopy.

Four arcuate segments 20*a*–20*d* are formed in plate 12. The segments form opposed pairs of segments which are centered on respective diagonals d1, d2 extending from the corners of plate 12. The width of each segment is sufficient for the head of a screw 22 (see FIG. 4) to fit through the segment.

A swivel bar 24 is rotatably mounted on a side 26 of plate 12. This is the side of the mounting plate to which an outlet box B attaches to the mounting plate. Swivel bar 24 is rotatable through 360°. The swivel bar has a middle section 24*a* which abuts side 26 of the barrier wall mounting plate. Outer sections 24*b*, 24*c* respectively extend outwardly of the ends of this middle section, these outer ends being raised away from the side of the mounting plate. Each outer section has an elongate slot 28*a*, 28*b* extending longitudinally of the swivel bar.

When the ends of the wires are spliced together and the wire nuts are fitted onto the wires, the mounting plate is attached to the outlet box using the screws 22. The threaded shank of the screws are inserted through one of the arcuate segments (segments 20*c* and 20*d* in FIG. 4) and then through one of the slots 28*a*, 28*b* into a treaded bore (not shown) in the base of the outlet box. The slot width is sufficiently narrow so the head of the screws do not fit through the slots. Thus, when the screws are tightened, mounting plate 10 is drawn up tight against the outlet box. The screws E are now threaded through the tapped bores 18*a*, 18*b* in the plate and through the openings in the canopy. The exposed ends of the screws are covered by the cap nuts T to again provide a decorative appearance.

Because the outlet box is attached to the swivel bar portion of the mounting plate, fixture F can be oriented as desired by the installer without having to make cumbersome adjustments to the fixture/outlet box assembly. And, in accordance with paragraph 7.1 of Underwriter's Laboratory (UL) standard 1571 the spliced ends of the wires are not exposed. However, whereas in the prior art construction of FIG. 1, the outlet box and fixture canopy defined the enclosure in which the spliced ends of the wires were contained; now, this enclosure is defined by the outlet box and barrier wall mounting plate 10. Additionally, the novel construction of barrier wall mounting plate 10 allows the electrical fixture (whether or not a lighting fixture) to be molded out of polymeric materials which do not have to meet UL requirements for an electrical enclosure. The design of mounting plate 10 also addresses those requirements relating to the maximum size of open holes in an enclosure such as are specified in Table 9.1 of UL standard 1571 relating to incandescent fixtures. Finally, while lighting fixture F is for use with an incandescent light bulb I, the mounting plate 10 construction described herein is also useful with fixtures for fluorescent lights and other types of lighting as well.

Figure 4:
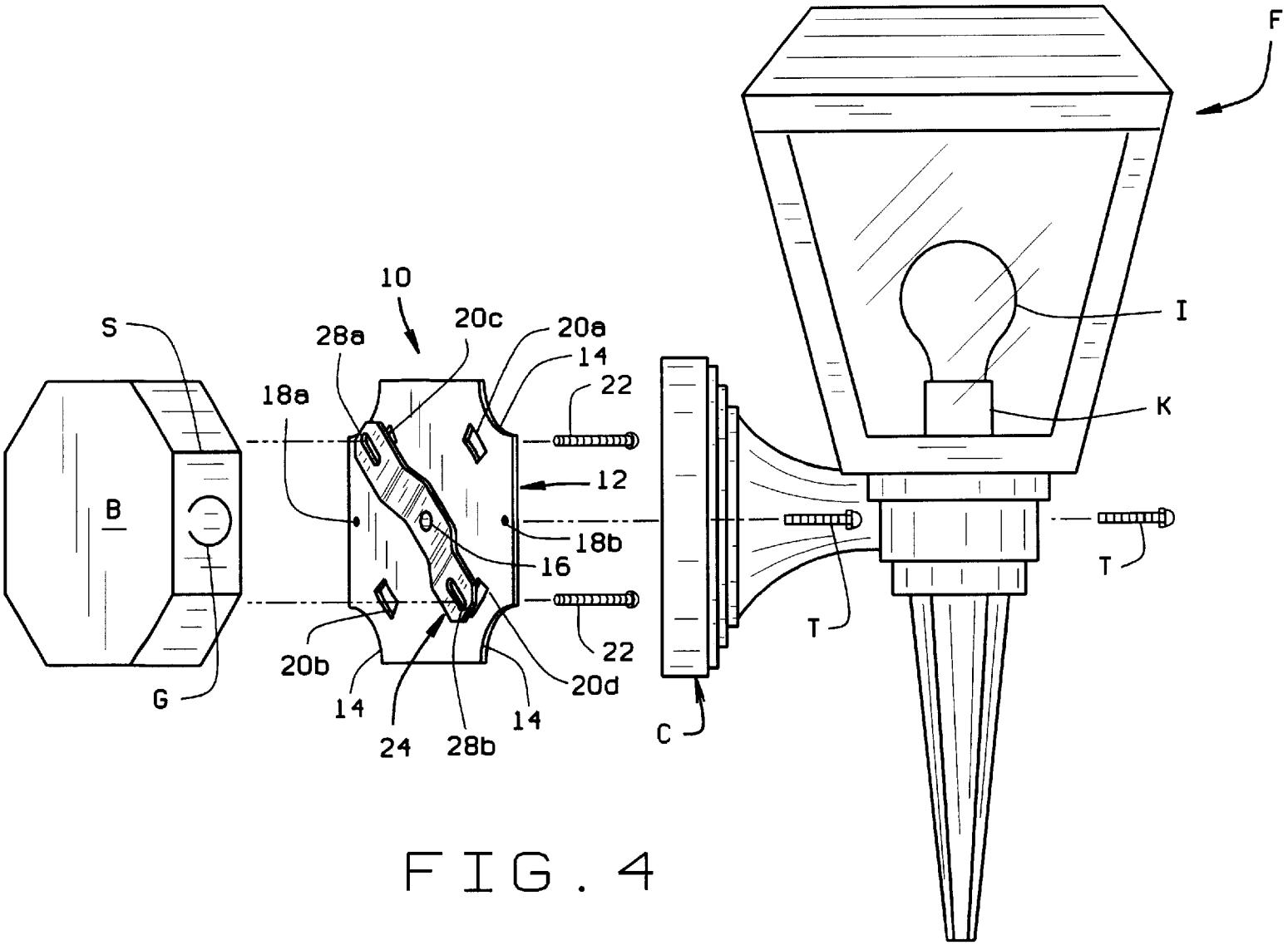
FIG. 4 is an exploded view illustrating an electrical fixture/outlet box assembly using the mounting plate of the present invention.

Although not shown in the drawings, it will be understood by those skilled in the art that barrier wall mounting plate 10 can be installed backward to the installation shown in FIG. 4. That is, plate 12 could be attached to outlet box B and swivel bar 24 to canopy C.

Referring to FIGS. 5A, 5B and 6A, 6B, other barrier wall mounting plate constructions are indicated 30 and 50 respectively. Each mounting plate includes a flat plate 32, 52 with scalloped corners 34, 52. An opening 36, 56 is formed in the respective plates for routing the electrical wiring. Each plate has opposed, tapped openings 38*a*, 38*b* and 58*a*, 58*b* respectively, these openings being in wells 39, 59 formed in the respective plates 32, 52. Four arcuate segments 40*a*–40*d* and 60*a*–60*d* constructed in the same manner as the segments 20*a*–20*d* are formed in the respective plates 32, 52. Swivel bars 44, 64 and attached on sides 46, 56 of the plates 32, 52. Elongate slots 48*a*, 48*b* and 68*a*, 68*b* are formed at the respective ends of each bar 46, 66, the slots extending longitudinally of the respective swivel bars. Use and installation of the barrier wall mounting plates 30, 50 is as previously described.

FIGS. 7A, 7B illustrate a circular barrier wall mounting plate 70. Since plate 70 is circular and not square or rectangular, it does not have scalloped corners. Again, the mounting plate firs within a similarly shaped fixture canopy. The reference numerals designating the various portions of the mounting plate and its swivel bar correspond to the designations in previously described embodiments.

Referring to FIGS. 8A and 8B a barrier wall mounting plate 100 comprises a generally rectangular plate 102 having a rounded end 103. Wiring from the lamp socket is extended through an opening 106 in the plate, and the plate has a tapped hole 108 for attaching barrier wall mounting plate 100 to canopy C of a fixture.

This embodiment of the barrier wall mounting plate includes no swivel bar as do the previously described embodiments. Rather, a barrier wall mounting plate 100 has two sets of arcuate slots comprising an inner set of slots 120*a*–120*d* and an outer set of slots 122*a*–122*d*. The respective sets of slots allow plate 100 to be used with different size outlet boxes. Screws (not shown) are inserted through opposed slots in the respective set of slots. The slot width is less than the diameter of the head of a screw. The screws are not fully tightened when first threaded into threaded openings in the outlet box. Rather the outlet box/plate assembly are first rotated so the fixture is in a desired orientation and then the screws are tightened.

What has been described is an electrical lighting fixture including a mounting plate attachable to a portion of the fixture through which electrical wiring for the fixture is routed. This wiring is connected, in turn, to electrical wiring routed from a power source to the fixture through an outlet box. The mounting plate includes a swivel bar to which the outlet box attaches. The electrical wiring, including spliced together sections of wiring, are enclosed within the outlet box and mounting plate, as is required for UL listing. Attaching the outlet box to the swivel bar allows the electrical fixture to be mounted in a preferred orientation regardless of the orientation of the outlet box. Or, the mounting plate has sets of arcuate slots which are used for attaching the fixtures to the outlet box.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. In an electrical fixture having a cover on which a canopy is formed for electrical wiring of a socket of the fixture to be routed through the canopy with one end of each wire electrically connected to the socket and the other, free end thereof extending through the canopy, the fixture being attached to an outlet box through which electrical wires for connecting the fixture to a power source are routed, the improvement comprising:

a barrier wall mounting plate fitting over an opening defined by the fixture canopy, the plate having an opening therein through which the free ends of the wires extend, the free ends of the wires being spliced together with ends of the electrical wires routed through the outlet box, the mounting plate including means attaching the plate to the outlet box with the electrical fixture being rotatable relative to the resulting outlet box/mounting plate assembly for the fixture to be positioned in a preferred orientation regardless of the orientation of the outlet box, and with all of the electrical wires being completely enclosed by the outlet box and mounting plate.

2. The improvement of claim 1 wherein said mounting plate includes a swivel bar rotatably attached to the plate on a side thereof to which the outlet box attaches, attachment of the outlet box to the swivel bar allowing the fixture to be positioned in a preferred orientation regardless of the orientation of the outlet box.

3. The improvement of claim 2 wherein said swivel bar includes an elongate slot at each end thereof through which a screw for attaching the outlet box and mounting plate together is inserted.

4. The improvement of claim 3 wherein the width of the slot is narrower than the head of the screw so to draw the swivel bar up against the outlet box as the screw is tightened.

5. The improvement of claim 4 wherein said mounting plate includes a flat plate in which a plurality of arcuate segments are formed, the arcuate segments being larger in width than the head of a screw for the screw to be inserted through a slot in the swivel bar from the side of said plate opposite that to which the outlet box is mounted.

6. The improvement of claim 5 further including means attaching the mounting plate to the canopy after the mounting plate is attached to the outlet box, the swivel bar being rotatable through 360° so to allow the fixture to be rotated relative to the outlet box to a desired position.

7. The improvement of claim 1 wherein the means attaching the plate to the outlet box includes a plurality of arcuate segments formed in the mounting plate and spaced uniformly thereabout, screws for attaching the mounting plate and the outlet box together being inserted through opposing segments with the segments being smaller in width than the head of a screw for the screw, when tightened, draws the outlet box and mounting plate together, the fixture being oriented in a desired position before the screws are tightened.

8. The improvement of claim 7 further including an inner set of arcuate segments and an outer set thereof, said sets being concentric with arcuate segments from one set or the other being used depending upon the size of the outlet box to which the fixture is connected.

9. (Amended) An electrical lighting fixture comprising:

a lamp socket in which a light bulb is inserted:

a cover for the lamp socket including a canopy formed for electrical wiring to the lamp socket to be routed through the canopy with one end of each of a plurality of electrical wires to be electrically connected to the socket and the other, free end thereof extending through the canopy, the fixture being attached to an outlet box through which electrical wires for connecting the fixture to a power source are routed; and, a barrier wall mounting plate fitting over an opening defined by the canopy, the plate having an opening therein through which the free ends of the wires extend, the free ends of the wires being spliced together with ends of the electrical wires routed through the outlet box, the mounting plate including a swivel bar rotatably attached to the plate on a side thereof to which the outlet box attaches, attachment of the outlet box to swivel bar allowing the fixture to be positioned in a preferred orientation regardless of the orientation of the outlet box, and with all of the electrical wires being completely enclosed by the outlet box and mounting plate.

10. The lighting fixture of claim 9 wherein said swivel bar is rotatable through 360° for the fixture to be oriented in a desired position with respect to the outlet box.

11. The lighting fixture of claim 10 wherein said swivel bar includes an elongate slot at each end thereof through which a screw for attaching the outlet box and mounting plate together is inserted.

12. The lighting fixture of claim 11 wherein the width of the slot is narrower than the head of the screw so to draw the swivel bar up against the outlet box as the screw is tightened.

13. The lighting fixture of claim 12 wherein said mounting plate includes a flat plate in which a plurality of arcuate segments are formed, the arcuate segments being larger in width than the head of a screw for the screw to be inserted through a slot in the swivel bar from the side of said plate opposite that to which the outlet box is mounted.

14. The lighting fixture of claim 13 further including screws for attaching the mounting plate to the canopy after the mounting plate is attached to the outlet box, the swivel bar allowing the fixture to be rotated relative to the outlet box to a desired position.

15. An electrical lighting fixture comprising:

a lamp socket in which a light bulb is inserted:

a cover for the lamp socket including a canopy formed for electrical wiring to the lamp socket to be routed through the canopy with one end of each of a plurality of electrical wires to be electrically connected to the socket and the other, free end thereof extending through the canopy, the fixture being attached to an outlet box through which electrical wires for connecting the fixture to a power source are routed; and, a barrier wall mounting plate fitting over an opening defined by the canopy, the plate having an opening therein through which the free ends of the wires extend, the free ends of the wires being spliced together with ends of the electrical wires routed through the outlet box, the mounting plate including a plurality of arcuate segments formed in the mounting plate and spaced uniformly thereabout, screws for attaching the mounting plate and the outlet box together being inserted through opposing segments with the segments being smaller in width than the head of a screw so the screw, when tightened, draws the outlet box and mounting plate together, the fixture being oriented in a desired position before the screws are tightened, attachment of the outlet box to the mounting plate allowing the fixture to be positioned in a preferred orientation regardless of the orientation of the outlet box, and with all of the electrical wires being completely enclosed by the outlet box and mounting plate.

16. The electrical lighting fixture of claim 15 further including an inner set of arcuate segments and an outer set thereof, said sets being concentric with arcuate segments from one set or the other being used depending upon the size of the outlet box to which the fixture is connected.

* * * * *

UNITED STATES PATENT AND TRADEMARK OFFICE

CERTIFICATE OF CORRECTION

PATENT NO. : 6,257,743 B1
DATED : July 10, 2001
INVENTOR(S) : Ursch

It is certified that error appears in the above-identified patent and that said Letters Patent is hereby corrected as shown below:

Column 1,
Line 64, insert paragraph beginning with "Another object of the invention"

Column 6,
Line 1, after the numeral "9." delete "(Amended)".

Signed and Sealed this

Ninth Day of April, 2002

*Attest:*

*Attesting Officer*

JAMES E. ROGAN
*Director of the United States Patent and Trademark Office*